US009103220B2

(12) United States Patent
Garin et al.

(10) Patent No.: US 9,103,220 B2
(45) Date of Patent: Aug. 11, 2015

(54) INTERFACE ELEMENT BETWEEN A BLADE ROOT AND A BLADE ROOT HOUSING OF A TURBINE DISC, AND TURBINE ROTOR COMPRISING AN INTERFACE ELEMENT

(75) Inventors: Fabrice Marcel Noel Garin, Boissise la Bertrand (FR); Alain Dominique Gendraud, Vernou la Celle sur Seine (FR); Thierry Lequitte, Cesson (FR); Romain Nicolas Lunel, Montereau sur le Jard (FR)

(73) Assignee: SNECMA, Paris (FR)

( * ) Notice: Subject to any disclaimer, the term of this patent is extended or adjusted under 35 U.S.C. 154(b) by 474 days.

(21) Appl. No.: 13/643,569

(22) PCT Filed: Apr. 20, 2011

(86) PCT No.: PCT/FR2011/050913

§ 371 (c)(1), (2), (4) Date: Nov. 29, 2012

(87) PCT Pub. No.: WO2011/135234

PCT Pub. Date: Nov. 3, 2011

(65) Prior Publication Data

US 2013/0078101 A1 Mar. 28, 2013

(30) Foreign Application Priority Data

Apr. 26, 2010 (FR) ..... 10 53184

(51) Int. Cl.
*F01D 5/30* (2006.01)
*F01D 5/08* (2006.01)

(52) U.S. Cl.
CPC ..... *F01D 5/3092* (2013.01); *F01D 5/081* (2013.01); *F01D 5/3007* (2013.01); *F05D 2240/81* (2013.01); *F05D 2250/70* (2013.01); *F05D 2250/71* (2013.01); *F05D 2260/20* (2013.01); *F05D 2260/30* (2013.01); *F05D 2260/36* (2013.01); *F05D 2260/941* (2013.01); *F05D 2260/96* (2013.01)

(58) Field of Classification Search
CPC ..... F01D 5/30; F01D 5/081; F01D 5/3007; F01D 5/3092
USPC ..... 416/224, 248
See application file for complete search history.

(56) References Cited

U.S. PATENT DOCUMENTS

| | | | |
|---|---|---|---|
| 2,779,565 | A | 1/1957 | Bruckmann |
| 5,003,766 | A | 4/1991 | Paul |

FOREIGN PATENT DOCUMENTS

| | | |
|---|---|---|
| FR | 2 105 791 | 4/1972 |
| JP | 62 041902 | 2/1987 |

(Continued)

OTHER PUBLICATIONS

International Search Report Issued Nov. 14, 2011 in PCT/FR11/050913 Filed Apr. 20, 2011.

*Primary Examiner* — Richard Edgar
(74) *Attorney, Agent, or Firm* — Oblon, McClelland, Maier & Neustadt, L.L.P.

(57) ABSTRACT

An interface element to be mounted between a blade root and a blade root housing provided in a turbine disc of a gas turbine engine to limit wear between the root and the housing. The interface element includes: a base, configured to be aligned with a lower part of the root; and first and second upper side walls connected to the base and configured to surround the blade root up to an upper portion thereof, the first upper side wall including at least one ventilation opening to allow a flow of cooling air flowing through the rotor disc housing to flow over the upper portion of the root via the ventilation opening.

9 Claims, 3 Drawing Sheets

(56) References Cited

FOREIGN PATENT DOCUMENTS

| | | | |
|---|---|---|---|
| JP | 63 173801 | | 7/1988 |
| JP | 63173801 | A * | 7/1988 |
| JP | 07 189606 | | 7/1995 |
| JP | 09 q250303 | | 9/1997 |

* cited by examiner

INTERFACE ELEMENT BETWEEN A BLADE ROOT AND A BLADE ROOT HOUSING OF A TURBINE DISC, AND TURBINE ROTOR COMPRISING AN INTERFACE ELEMENT

The invention relates to the field of turbine machine rotors and, more particularly, cooling of the rotor blades on a rotor disc.

A front blower double body turbojet engine, for example, conventionally comprises, from upstream to downstream, a blower, a low pressure compressor stage, a high pressure compressor stage, a combustion chamber, a high pressure turbine stage and a low pressure turbine stage.

By convention, in the present application, the terms "upstream" and "downstream" are defined with respect to the air circulation direction in the turbojet engine. Also, by convention, in the present application, the terms "internal" and "external" are radially defined with respect to the engine axis. Thus, a cylinder extending according to the engine axis comprises an internal side turned up to the engine axis and an external side opposed to the internal side thereof.

Referring to FIGS. 1 and 2, a low pressure turbine stage, for example, comprises successive rotor discs 10 each comprising axial or oblique grooves 13, being known from the man of the art under the name of recess, within which roots 22 of blades 20 are housed, the blades 20 radially extending outside with respect to the engine axis. Such grooves 13 are also called housings 13 further on.

Each rotor disc 10 comprises "whiskers" arranged on either part of the disc 10 and called upstream whisker and downstream whisker further on. The upstream whisker of the rotor disc 10 is formed by a radial annular flange 11 connected to the upstream side of the rotor disc through an annular frusto-conical ferrule 12 being flared upstream.

Referring to FIGS. 1 and 2, the roots 22 of the blades 20 are radially retained in the grooves 13 through their bulbous section, so-called a dovetail. A metal interface element 5, being known from the man of the art as "shim" located between the root 22 of the blade 20 and the bottom of the groove 13, as shown on FIG. 2, is arranged to restrain wear against the blade root 22 and the internal surface of the groove 13 of the rotor disc 10.

The interface element 5 comprises a full bottom wall and two full upper side walls being connected to the bottom wall so as to enclose the root 22 of the blade 20 so as to avoid that the external surface of the root 22 is in contact with the internal surface of the housing 13.

The roots 22 of the blades 20 are axially retained by an upstream ring axially abutting on an upstream part of the roots 22 of the blades 20. The ring 30 is radially retained in radial hooks arranged in the platform 21 of the blades 20 and axially by a flange 40 holding the ring 30.

The flange 40 covers externally the upstream frusto-conical ferrule 12 of the rotor disc 10, thereby allowing the rotor disc 10 to be thermally protected against the high temperature of gases exiting from the combustion chamber of the engine.

Referring to FIG. 1, a cooling channel is arranged between the flange 40 and the upstream ferrule 12 of the rotor disc 10 so as to guide a fresh air flow F, taken in upstream from the low pressure turbine stages within the housings 13 of the blades 20 arranged in the rotor disk. Air F circulates in the grooves 13 under the interface elements 5 enclosing the roots 22 of the blades 20 so as to protect them against excessive temperatures. The circulation of the fresh air flow F is represented by arrows on FIG. 1, the fresh air flow F opening downstream from the rotor disc 10 between the root 22 of the blade 20 and the housing bottom 13.

The cooling channel allows the lower part 23 of the roots 22 of the blades 20 to be cooled efficiency, i.e. the radially lower part 23 of the root 22 which is the closest of the bottom of the grooves 13 of the rotor disk 10 as represented on FIG. 2.

On the contrary, the upper part of the rotor disc 10 facing the upper part 24 of the root 22 of the blade 20, i.e. the radially external part 24 of the root 22 which is the closest of the platform 21 of the blades 20 is not sufficiently cooled, the fresh air flow F not circulating in the vicinity of the upper part 24 of the root 22 of the blade 20 and the upper part of the rotor disc 10.

To solve this problem, the patent application EP 1,464,792 A1 is known, learning a low pressure turbine for a gas turbine engine comprising radial housings formed in the rotor disc to receive the blade roots. In order to allow a cooling of the upper part of the blade root, the root comprises an internal ventilation channel radially extending in the root and opening, in the one side, into the lower wall of the lower part of the root and, on the other side, in the side wall of the upper part of the root so as to allow fresh air flow to cool the root internally. In other words, each blade root comprises an internal ventilation channel arranged to communicate the lower part of the blade root with the upper part thereof.

An internal ventilation channel weakens the blade root being submitted to very important mechanical and thermal constraints.

Moreover, the blade of the patent application EP 1,464,492 A1 needs a housing adapted to allow the air flow from the ventilation channel to cool the upper part of the rotor disc. Thus, such a blade cannot be used for turbine engines which are already in circulation and the housings of which have conventional shapes.

In order to eliminate at least some of such drawbacks, the invention relates to an interface element adapted to be mounted between a blade root and a blade root housing arranged in a turbine disc of a gas turbine engine to limit the wears between the root and the housing thereof, the interface elements comprising a bottom wall adapted to correspond with a lower part of the root, and two upper side walls connected to the bottom wall and adapted to enclose the blade root up to a upper part of the root, wherein at least one first upper side wall comprises at least one ventilation opening with a configuration to allow a cooling air flow circulating in the housing of the rotor disc to circulate on the upper part of the root via said ventilation opening.

Thanks to the invention, the interface element fulfills a double function. It allows, on the one side, to restrain the wear between the root and the housing thereof and, on the other side, to cool the upper part of the rotor disc being submitted to high temperatures. Furthermore, the presence of a ventilation opening in the upper side wall allows the thermal conductibility of the calories to be restrained from the upper part of the root towards the lower part thereof. In other words, the presence of a ventilation opening allows the heat resistance of the interface element to be increased.

Furthermore, the overall dimensions of the interface element according to the invention are substantially identical to those of the interface element according to the prior art. An interface element according to the invention can thus advantageously be mounted on a circulating engine to improve the cooling of the blade root.

The modification of the interface element to improve cooling allows the modification of the rotor to be restrained to only one part, the rotor disc or the blade being not advantageously modified.

According to one aspect of the invention, said ventilation opening is rectilinear.

According to another aspect of the invention, said ventilation opening extends according to the height of the first side wall. Advantageously, the lower part of the blade root communicates with the upper part of the blade root.

Preferably, said ventilation opening extends over 30% to 90% of the height of the first side wall.

According to the invention, the second side wall comprises a ventilation opening arranged facing the ventilation opening of said first side wall. Consequently, both side walls of the blade root are simultaneously cooled.

According to another aspect of the invention, said upper side wall comprising at least two ventilation openings, the dimensions of the ventilation openings are identical.

The invention also relates to a rotor for a gas turbine engine comprising a rotor disc including at least one housing in which a blade root is housed, on which a previously presented interface element is mounted to restrain the wears between the root and the housing thereof.

Preferably, the root having a dovetail shape, each upper side wall comprising a base portion, connected to the bottom wall, and an intermediate portion connected to the base portion by a bent portion, said ventilation opening is continuous between the base portion and the intermediate portion of the first upper side wall. The lower part of the blade root is advantageously in communication with the upper part of the blade root.

According to one aspect, a cooling air flow circulating from upstream to downstream, in the housing of the rotor disc, the ventilation opening extends obliquely in the upper side wall of a radially internal upstream part towards a radially external downstream part of said upper side wall. Thus, the cooling air flow is deviated obliquely from the lower part of the root towards the upper part thereof.

According to another aspect, a cooling air flow circulating from upstream to downstream in the housing of the rotor, an upper side wall of the interface element comprising at least an upstream ventilating opening and a downstream ventilation opening, the dimensions of the upstream opening are bigger than the dimensions of the downstream opening. The cooling air flow rate is more important upstream, thereby allowing the cooling air flow to reach quicker the upper part of the root to cool it upon its circulation from upstream to downstream.

Other characteristics and advantages of the invention will appear in the following description relative to the accompanying drawing given as a non limitative example, wherein.

Figure 1:
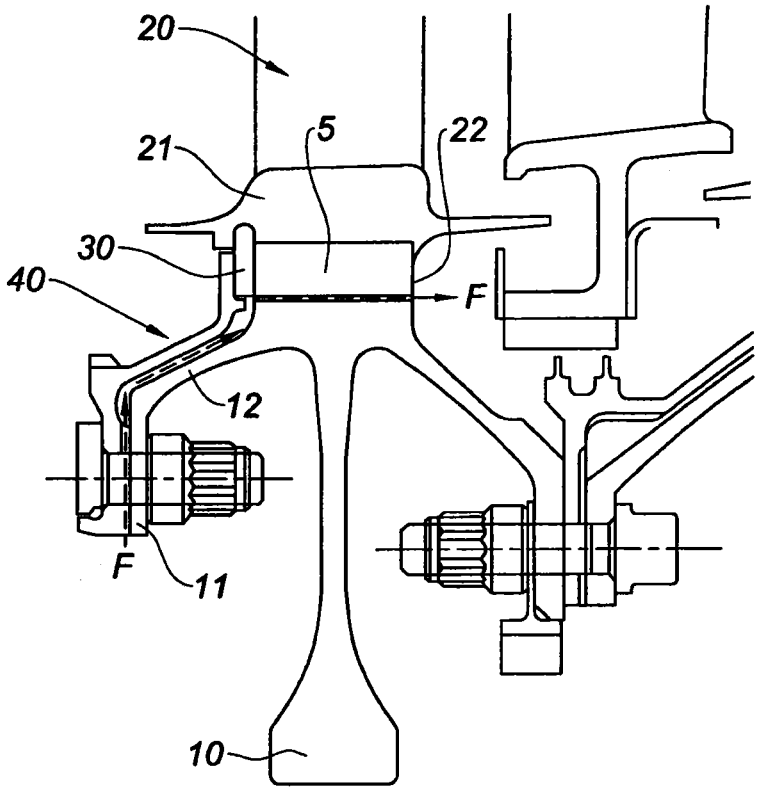
FIG. 1 is a longitudinal sectional view of a rotor for a gas turbine engine in which a blade root, with an interface element according to the prior art, is mounted in a housing of a rotor disc, the circulation of a cooling air flow according to the prior art being represented (already discussed)
Figure 2:
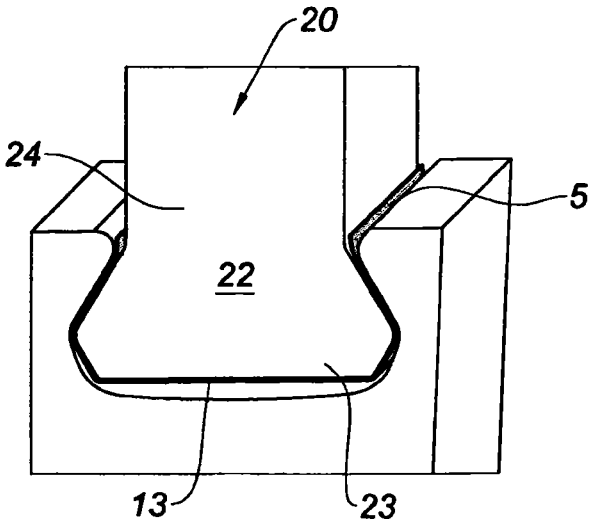
FIG. 2 is a view of the blade root with the interface element according to the prior art, being mounted in the housing of the rotor disc (already discussed)
Figure 3:
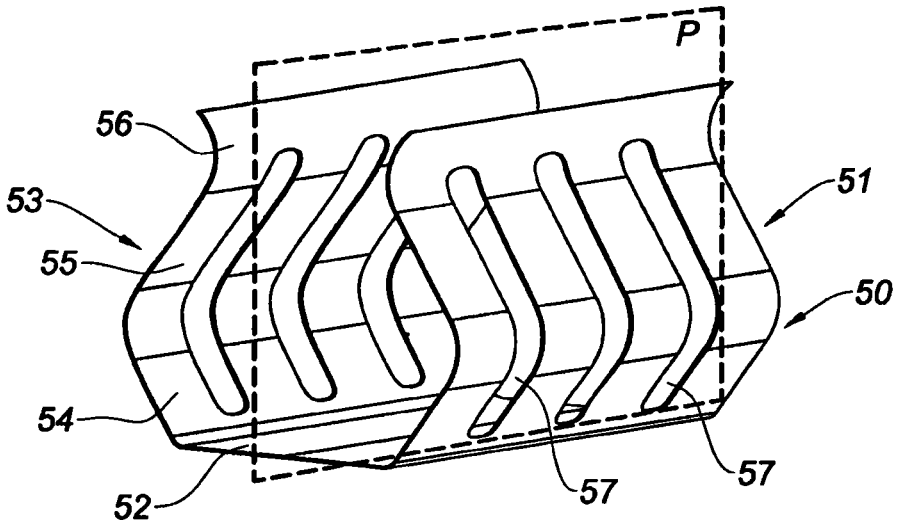
FIG. 3 is a perspective representation of an interface element according to the invention.

An interface element 50 adapted to be mounted between a root 22 of a blade 20 and a housing 13 of the blade 20 root 22 arranged in a turbine disc 10 of a gas turbine engine is represented referring to FIG. 3.

The interface element 50, preferably in metal, comprises a bottom wall 52 adapted to be in contact with an upper part 23 of the root 22, and two upper side walls 51, 53 connected to the bottom wall 52 and adapted to enclose the root 22 of the blade 50 up to an upper part 24 of the root 22. When the interface element 50 is mounted on the root of the blade 20, it allows the wears between the root 22 and the housing 13 thereof to be restrained.

Figure 4:
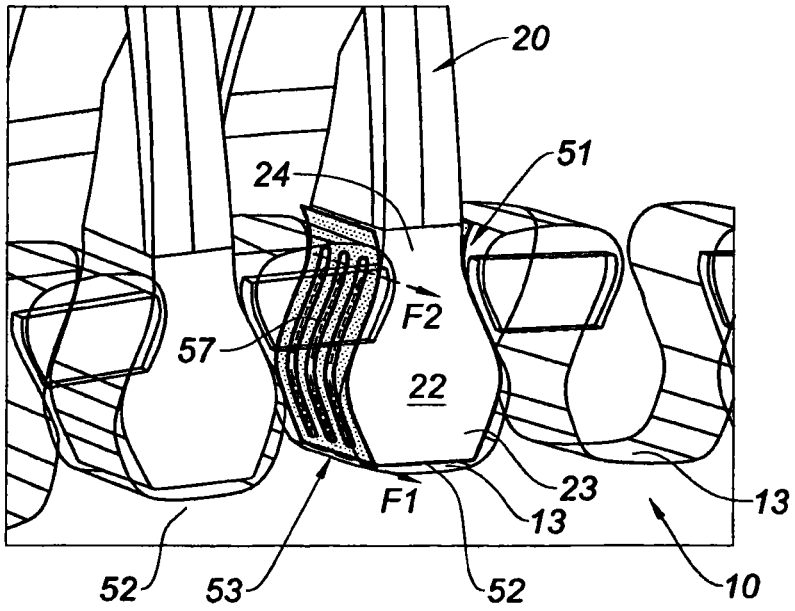
FIG. 4 is a perspective view of a rotor of a gas turbine engine, wherein a blade root, with an interface element according to the invention is mounted in a housing of a rotor disc, the rotor disc being represented in transparency.

Subsequently, the terms "left" and "right" are defined with respect to FIG. 4 representing the interface element 50 in a mounted position in a turbine rotor according to the invention, only the left side wall 53 being visible on FIG. 4.

Still in reference to FIG. 4, the turbine rotor comprises a rotor disc 10 extending in a radial plane with respect to the axis of the engine, comprising a plurality of radial housings 13 arranged on the periphery of the rotor disc 10. Such housings 13 are known from the man of the art under the name of recesses. Radial blades 21 are arranged on the rotor disc 10 so as to be driven in rotation by the rotor 10. With this end in view, each blade 20 comprises a head adapted to accelerate a hot air flow circulating within the engine and the root 22 adapted to be mounted in the rotor disc 10.

In such example, each root 22 of a blade 20 is radially retained in the housing 13 thereof by its bulbous section, so called a dovetail, the housing 13 having a complementary shape to this of the root 22 of the blade 20. It goes without saying that the housings 13 of the turbine disc 10 and the roots 22 of the blades 20 can be of various shapes, the important being that the root 22 cooperates with its housing 13 by a shape complementarity so as to keep a radial support of the blade 20 with respect to the turbine disc 10.

In this example, referring to FIG. 3, each side wall 51, 53 of the interface element 50 comprises consecutively a rectilinear base portion 54 being connected to the bottom wall 52, an intermediate rectilinear portion 55 and a rectilinear free portion 56, the intermediate rectilinear portion 55 being connected to the base portion 54 and to the free portion 56 by bent parts. In other words, each side wall 51, 53 presents two inflection points so as to allow the dovetail-shaped blade root 22 to be enclosed.

As represented on FIG. 4, the root 22 of the blade 20 comprises a lower part 23 being radially internal, and an upper part 24, being radially external and with a weaker section than the section of its lower part 23. The interface element 50 is arranged to enclose the root 22 of the blade 20 while covering its left side surface, its lower surface and its right side surface so as to prevent the root of the blade 20 to be in direct contact with the internal surface of the housing 13 of the turbine disc 10. With this aspect in view, the interface element 50 substantially has the same longitudinal length as the root of the blade 20 for which it is intended.

The side walls 51, 53 of the interface element 50 radially extend up to the upper part 24 of the blade root 22. In other terms, the free end of each side wall 51, 53 of the interface element 50 extends up to the periphery of the rotor disc 10 so as to protect the whole side surface of the blade root 20. The base portion 54 of each side wall 51, 53 covers the lower part 23 of the blade root 22, whereas the intermediate portion 55 of each side wall 51, 53 covers the upper part 24 of the blade root 20.

As previously indicated, due to the circulation of the hot air flow in the vicinity of the head of the blade 20, the temperature of the upper part 24 of the root 22 of the blade 20 is higher than the one of the lower part 23 thereof.

Figure 5:
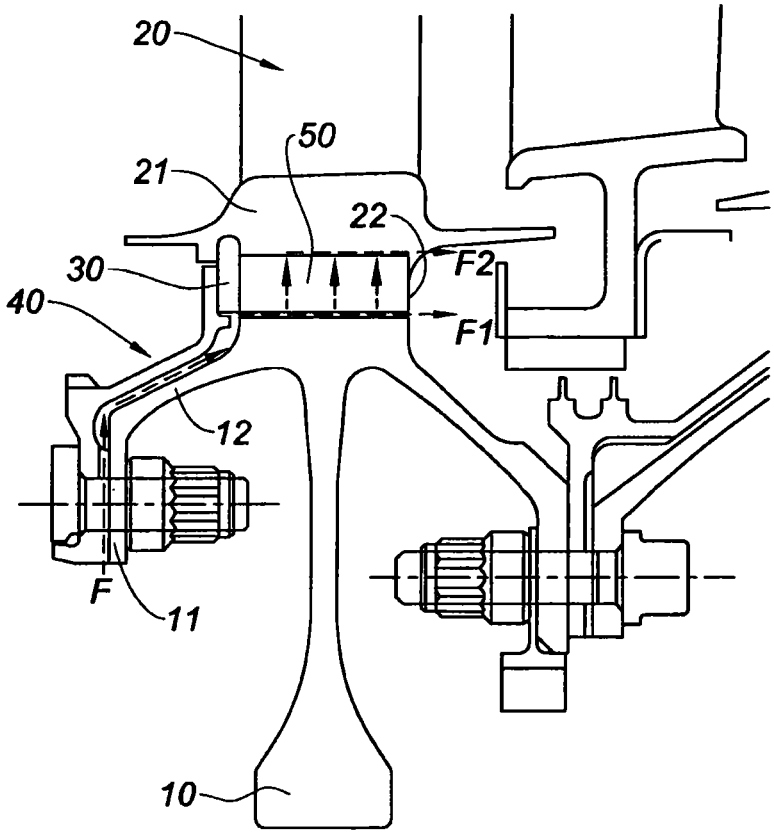
FIG. 5 is a longitudinal sectional view of the rotor of FIG. 4, the circulation of a cooling air flow according to the invention being represented.

Referring to FIG. 5, a cooling air flow F circulates from upstream to downstream in the housings 13 of the turbine disc 10 so as to cool the interface element 50 by thermal conduction. According to the invention, the side walls 51, 53 of the interface element 50 are perforated so as to allow the circulation of the cooling air flow F on the side surface of the blade root 22, while preventing the frictions between said blade root 22 and the housing 13 thereof.

Advantageously, the perforated interface element 50 also allows the heat resistance thereof to be increased, while restraining heat conduction from the upper part 24 of the blade root 22 towards the lower part 23 thereof.

Referring to FIG. 3, the right 51 and left 53 upper side walls each comprise three ventilation openings 57 with such a configuration to allow the cooling airflow F circulating in the housing 13 of the rotor disc 10 to cool the upper part 24 of the root 22 via said ventilation openings 57.

The invention is presented in this example with three ventilation openings 57 arranged in each of the upper side walls 51, 53 of the interface element 50, but the invention also aims at any interface element 50 comprising at least one ventilation opening 57 in at least one upper side wall 51, 53. In particular, the invention aims at an interface element with one single ventilation opening 57 arranged in one single upper side wall 51, 53.

In this example, referring to FIG. 3, each ventilation opening 57 of one same side wall 51, 53 extends continuously from the base portion 54 to the intermediate portion 55 of said side wall 51, 53. Thus, each ventilation opening 57 allows the lower part 23 of the blade root 22 (in contact with the base portion 54) to communicate with its upper part 24 (in contact with the intermediate portion 55). The cooling air flow allows the upper part 24 of the blade root 22 as well as the upper part of the rotor disc 10 which is thermally exposed, to be cooled.

It goes without saying that one ventilation opening 57 could extend over a unique rectilinear portion of each side wall 51, 53, over two consecutive portions or over the three ones. Moreover, a ventilation opening 57 could also extend in one side wall 51, 53 and in the bottom wall 52.

In this example, the ventilation openings 57 of a same side wall 51, 53 are parallel with each other. In other terms, the openings within each of the portions 54, 55, 56 of said side wall 51, 53 are parallel with each other. Moreover, the ventilation openings 57 of a same side wall 51, 53 are regularly spaced apart. The shape of the ventilation openings 57 as well as their distribution allows the upper part to be homogeneously cooled over the whole longitudinal length of the blade root 22.

The ventilation openings 57 are here substantially radial in the side walls 51, 53 of the interface element 50. In other words, each ventilation opening 57 belongs to a plane being transversal to the axis of the engine.

It goes without saying that the openings could also extend obliquely in a side wall 51, 53, preferably from a radially internal upstream part towards a radially external downstream part of said upper side wall 51, 53. With such oblique ventilation openings 57, the cooling air flow F is conducted with a high flow rate from the lower part 23 towards the upper part 24, thereby improving the transfers by thermal conduction.

In this example, the ventilation openings 57 have substantially the same dimensions, but the latter could be different. In particular, according to a non represented embodiment of the invention, the dimensions of the ventilation openings 57 are bigger in the upstream part of the interface element 50 than in the downstream part thereof.

Consequently, a cooling air flow with a more important flow rate circulates in the upstream ventilation openings, thereby allowing the airflow F to exchange calories with the upper part 24 of the root 22 by thermal conduction, while circulating longitudinally from upstream to downstream between the internal surface of the groove 13 and the upper part 24 of the root.

Referring to FIG. 3, the interface element 50 presents a symmetry plane P extending over its length perpendicularly to its bottom wall 52 so that the right side wall 51 is symmetrical of the left side wall 53 with respect to the symmetry plane P. The ventilation openings 57 of the left side wall 53 are facing the ventilation openings 57 of the right side wall 54. In a mounted position, the symmetry plane P is a longitudinal plane going through the axis of the engine.

When the interface element 50 is mounted on the blade root 22, the left side surface of the blade root 22 is partially visible through the ventilation openings 57 as represented on FIG. 4. In particular, the side surface of the lower part 23 and of the upper part 24 of the blade root 22 is visible, each ventilation opening 57 forming a cooling channel arranged to conduct the cooling air flow from the lower part 23 of the root 22 towards the upper part 24.

Although the interface element 50 comprises ventilation openings 57, this does not affect its interface function between the root 22 and its housing 13, the root of the blade 22 never being in direct contact with the internal surface of the housing 13. Preferably, a side wall 51, 53 of the interface element 50 is not perforated to more than 40% of its whole surface.

The circulation of the cooling air flow F in the rotor will be detailed referring to FIG. 5.

An inlet cooling air flow F is introduced upstream from the housing 13 and is divided, on the one side, into a main cooling air flow F1 circulating longitudinally from upstream to downstream in the housing 13 to escape at a radial height of the lower part 23 of the blade root 22, and, on the other side, into a plurality of elementary flows radially circulating towards outside in the cooling channels formed between the ventilation openings 57 of the interface element 50 and the internal surface of the housing 13.

The elementary flows open at radial height of the upper part 24 of the blade root 22 to be then longitudinally driven from upstream to downstream, the plurality of the elementary flows forming an auxiliary cooling flow F2 represented on FIG. 5. The elementary flows cool the upper part 24 by thermal conduction not only upon their radial circulation, but also upon their longitudinal circulation from upstream to downstream.

Thanks to this implementation of the invention, the upper part 24 of the blade root 22 is advantageously cooled by an auxiliary cooling flow F2 without modifying either the blade 20, or the rotor disc 10. The interface element 50 can thus be used for engines being presently in circulation to improve the cooling of the blades 20.

Advantageously, when the dimensions of the ventilation openings 57 are more important in the upstream part of the interface element 50 than in the downstream part thereof, the auxiliary cooling flow rate F2 is more important upstream from the upper part 24, thereby improving the cooling of the blades.

The interface element 50 which was before only considered as a wearing element forms according to the invention a cooling tubing to allow the cooling air flow F to reach the upper part 24 of the blade root 22.

The invention claimed is:

1. An interface element configured to be mounted between a root of a blade and a housing of the root of the blade arranged in a turbine disc of a gas turbine engine to restrain wear between the root and the housing thereof, the interface element comprising:

a bottom wall configured to correspond with a lower part of the root; and first and second upper side walls connected to the bottom wall and configured to enclose the blade root up to a upper part of the root, wherein at least the first upper side wall includes at least one ventilation opening with a configuration to allow a cooling air flow circulating in the housing of the rotor disc to circulate on the upper part of the root via the ventilation opening.

2. The interface element according to claim 1, wherein the ventilation opening is rectilinear.

3. The interface element according to claim 1, wherein the ventilation opening extends over 30% to 90% of a height of the first upper side wall.

4. The interface element according to claim 1, wherein the second upper side wall includes a ventilation opening arranged facing the ventilation opening of the first upper side wall.

5. The interface element according to claim 1, wherein the first upper side wall includes at least two ventilation openings, and dimensions of the ventilation openings are identical.

6. A rotor of a gas turbine engine comprising:

a rotor disc including at least one housing, in which a root of a blade is housed, on which an interface element is mounted according to claim 1 so as to restrain wear between the root and the housing thereof.

7. The rotor according to claim 6, wherein the root has a dovetail shape, each upper side wall including a base portion connected to the bottom wall, and an intermediate portion connected to the base portion by a bent portion, the ventilation opening is continuous between the base portion and the intermediate portion of the first upper side wall.

8. The rotor according to claim 6, wherein a cooling air flow circulates from upstream to downstream in the housing of the rotor disc, the ventilation opening extends obliquely in the first upper side wall from a radially internal upstream part towards a radially external downstream of the upper side wall.

9. The rotor according to claim 6, wherein a cooling air flow circulates from upstream to downstream in the housing of the rotor disc, the first upper side wall of the interface element includes at least one upstream ventilation opening and one downstream ventilation opening, dimensions of the upstream opening are more important than dimensions of the downstream opening.

* * * * *